United States Patent [19]

Goodstein

[11] 4,377,352

[45] Mar. 22, 1983

[54] SELF-ACTUATING WATER CONTAINMENT BARRIER

[76] Inventor: Charles B. Goodstein, 5706 Guava Dr., Tamarac, Fla. 33319

[21] Appl. No.: 222,165

[22] Filed: Jan. 2, 1981

[51] Int. Cl.[3] ..... E02B 7/20

[52] U.S. Cl. ..... 405/115; 405/107; 405/92

[58] Field of Search ..... 405/107, 115, 98, 91, 405/92, 28, 32

[56] References Cited

U.S. PATENT DOCUMENTS

| | | | |
|---|---|---|---|
| 1,058,289 | 4/1913 | Cadwallader | 405/91 |
| 2,434,457 | 1/1948 | Cruikshank | 405/107 |
| 3,218,810 | 11/1965 | Grether et al. | 405/107 |
| 4,252,461 | 2/1981 | Colamussi et al. | 405/91 X |

*Primary Examiner*—Dennis L. Taylor

*Attorney, Agent, or Firm*—Marvin Feldman; Stephen E. Feldman; Jules L. Chaboty

[57] ABSTRACT

A stanchion is constructed and designed so as to be emplaced near a body of water, with its upper pivotally mounted portion in a lowered position, and with the rising of the water, the pivotal section self-actuates and rises with the water level to form a water containment barrier which will redirect the waterflow and protect property disposed on the other side of the barrier. With the receding of the water level, the upper section of the stanchion is self-lowered, thus providing an aesthetically acceptable appearance. A plurality of such stanchions with interconnected flexible sheeting provides a continuous barrier which can contour a land mass adjacent to a body of water.

8 Claims, 4 Drawing Figures

SELF-ACTUATING WATER CONTAINMENT BARRIER

FIELD OF THE INVENTION

This invention relates to a barrier for containing water. Specifically, this invention relates to a water containment barrier for controlling and redirecting water flow so as to protect lives and property.

BACKGROUND AND DISCUSSION OF PRIOR ART

Heretofore it was known to erect artificial barriers, such as dams or levees, to prevent overflow of rising water. Such prior art attempts either required a fixed or substantially fixed, erected construction or required interposed mechanical action to raise the dam before the water would rise to a dangerous level.

Typical of these prior attempts are as shown and described in U.S. Pat. No. 449,185, granted Mar. 31, 1891, to D. H. Solomon; U.S. Pat. No. 982,621, granted Jan. 24, 1911, to T. W. Maxey, et al; U.S. Pat. No. 1,748,444, granted Feb. 25, 1930, to G. E. Dutton; U.S. Pat. No. 1,888,364, granted Nov. 22, 1932, to C. R. Van Orman; U.S. Pat. No. 2,068,537, granted Jan. 19, 1937, to F. Dorn; U.S. Pat. No. 2,669,845, granted Feb. 23, 1954, to E. Freyssinet; U.S. Pat. No. 3,218,810, granted Nov. 23, 1965, to T. Grether, et al; and U.S. Pat. No. 3,479,824, granted Nov. 25, 1969, to C. F. Schaaf, et al.

There prior art attempts were often difficult and costly to construct, and were aesthetically unacceptable. Further, and of particular importance, is wherein erection or adjustment was required prior to the water rising to a dangerous level. Often, the water level would rise too fast and flood before such action was or could be undertaken.

Now, however, there is provided by the present invention a water containment barrier which is self-actuating so as to be vertically movable with concommitant changes in the water level.

It is therefore a principal object of the present invention to provide a self-actuating water containment barrier.

It is another object of the present invention to provide a barrier as aforesaid which self-adjusts to the changing levels of a body of water.

It is still a further object of the present invention to provide a barrier as aforesaid which is aesthetically acceptable, particularly at low water levels.

It is still a further object of the present invention to provide a water containment barrier which is readily constructed of relatively inexpensive materials of practical design and operation.

IN THE DRAWINGS

SUMMARY OF THE INVENTION

Broadly speaking, the present invention comprises a self-movable stanchion emplaced near a body of water, which stanchion is raised and lowered with and by respective changes in water level. A plurality of such stanchions are mounted and interconnected with sheeting to form a barrier which can contour a particular land mass.

DESCRIPTION OF THE PREFERRED EMBODIMENTS

Figure 1:
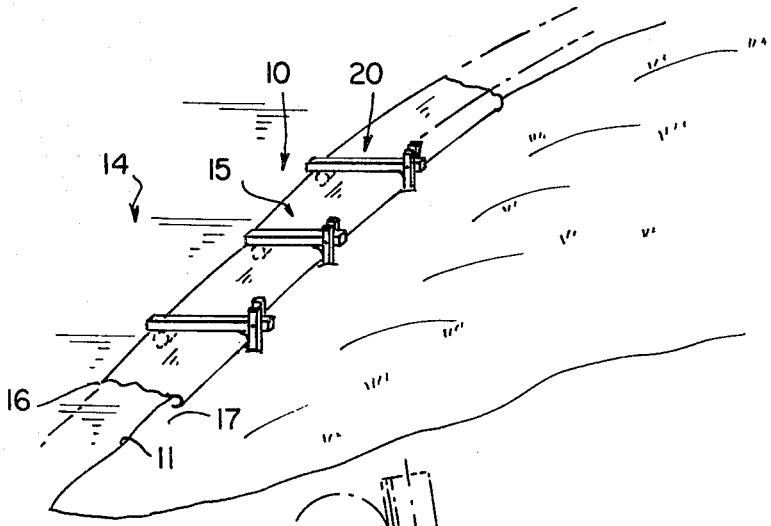
FIG. 1, is a perspective view of the water containment barrier emplaced in a river bank.
Figure 1:
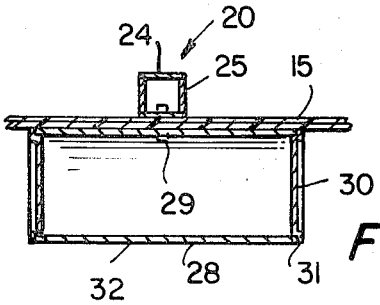
Figure 2:
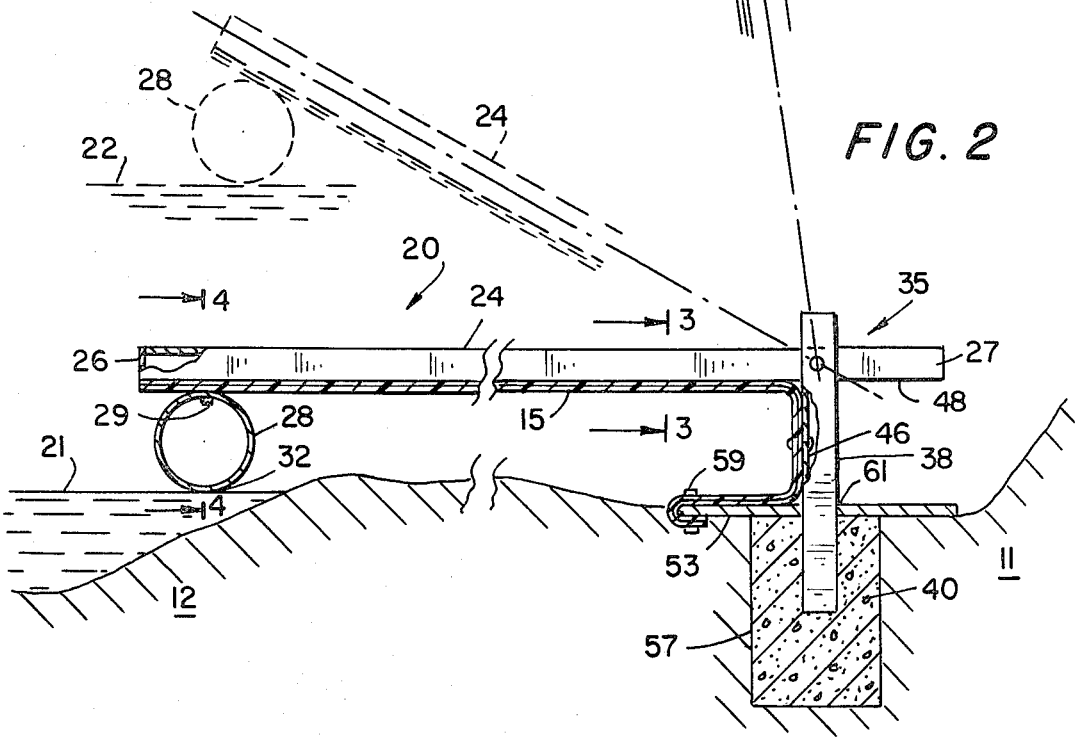
FIG. 2, is a side elevational and fragmentary sectional view of the barrier with broken line construction showing different positions at different water levels.

Referring to FIG. 1, there is shown the water containment barrier of the present invention generally referred to as 10, generally comprising a plurality of stanchions 20 interconnected by sheeting 15. Barrier 10 is shown as and may be arranged so as to contour an adjacent land mass, such as river bank 11, which is contiguous to river bed 12 (FIG. 2). As shown in FIG. 1, river 14 is at a low level mark such as shown at 16. With the stanchions 20 vertically downward (i.e., horizontal), the river 14 flows in its customary course without overflowing onto the river bank which is best shown at 17.

Figure 3:
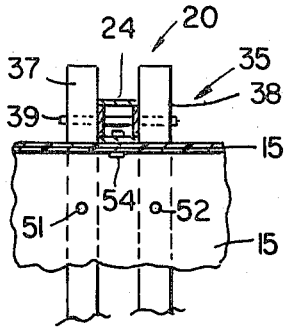
FIG. 3, is a sectional view taken along line 3—3 of FIG. 2.
Figure 4:
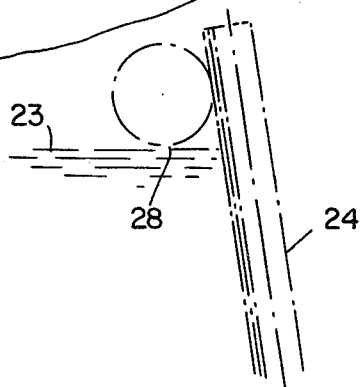
FIG. 4, is a sectional view taken along line 4—4 of FIG. 2.

Referring now to FIGS. 2–4, there is shown one of the stanchions 20 in full line drawing depicting the position of the stanchion at the low water level 21; and in first broken line drawing, at an intermediate water level position as at 22; and in second broken line drawing, at the full upward position of water level 23. Stanchion 20 comprises a tubular member or beam 24 of square cross-section 25 with end caps 26 and 27 at opposite ends so as to form a light weight, yet strong construction. A hollow cylindrical drum 28 is fixedly mounted to one side of member 24 by means of a fastener or bolt 29. Drum 28 is formed with cover 30 with fluid tight sealant 31 so that the drum is fully enclosed and forms a highly bouyant structure, whereby the drum outer periphery 32 contacts the surface of water. Instead of the drum 28 any hollow closed body, including without limitation, neoprene or other rubber tubing, may be used as the flotation member.

A pivot assembly 35 comprises parallel upright members or posts 37 and 38 fixedly mounted by anchor assembly 40 to the river bank 11. Transversely disposed stop means 46 bridge the posts 37 and 38, and are covered by sheeting 15, all for the purposes hereinafter appearing. Member 24 is formed with opposed transverse through holes for slidably, rotably engaging rod 39 (FIG. 3). A bearing sleeve or member (not shown) may also be provided. In this manner of construction, as the water level rises, such as in a flood situation, the rising water surface raises the drum and pivotally moves the stanchion vertically upwardly from level 21 through the intermediate level 22, and then to the uppermost level 23.

Stop means 46 is positioned so that end portion 48 of beam 24 abuts the stop 46 so as to prevent the stanchion from becoming full vertically upright. This is designed so as to permit the stanchion to readily return to its lowered position with receding water levels, whereas if the full upright condition were permitted, the stanchion might be locked vertically upright and not readily return downward with the receding water level.

Sheeting 15 is of high strength flexible polymeric material and is attached to the tubular member at convenient points such as at 54, as well as to the pivot posts as at 51, 52, and to anchor plate 53, as at 59. Anchor plate 53, is welded to posts 37 and 38, as at 61. This welded in place construction in combination, with concrete footing 57, provides fixed and secured support for the stanchion in the river bank.

It is to be borne in mind that in certain situations it may be useful to use a stanchion or plurality of stanchions without interconnected sheeting 15 to divert or modify the water flow pattern, but not as a containment structure.

The barrier of the present invention can be used to control flood waters, or for incoming tides and bores, as well as in estuaries for trapping waters, which trapped or contained water can in turn be used for driving turbines to generate electricity.

It is also to be borne in mind that when the water recedes to a low level and the stanchion is lowered to horizontal position, the stanchions are thereby protected from damage by wind, storms and tornadoes, as well as being aesthetically acceptable to the landscape.

From the foregoing description it will be obvious that there is shown a practical water barrier. It will be apparent that modifications may be made to the afore described embodiments without departing from the scope or spirit of the invention and the adjoined claims.

What is claimed is:

1. A barrier comprising a rigid stanchion;

means to mount said stanchion in a body of water so that said stanchion is pivotally upwardly movable;

said stanchion comprising floatation means mounted therewith so as to float on said body of water;

further comprising a plurality of said stanchions, and sheeting, and means to mount said sheeting to said stanchions so as to form a continuous barrier; further comprising means to anchor said sheeting along said stanchions, and wherein said sheeting extends substantially along the length of said stanchions, so that said sheeting moves together with the stanchions, whereby as said body of water rises, said stanchions together with the sheeting move upward to form a barrier.

2. The barrier of claim 1, further comprising pivot means to anchor said means near the body of water.

3. The barrier of claim 2, said flotation means and said pivot means being disposed at opposite ends of the stanchion.

4. The barrier of claim 3, said flotation means comprising a closed hollow body mounted to said stanchion.

5. The barrier of claim 2, further comprising stop means to limit the upward pivot movement of the stanchion to a point less than full upright position so that with receding water levels the stanchion will be self-actuatingly lowered.

6. The barrier of claim 1, said sheeting comprising water-impermeable polymeric material.

7. The barrier of claim 1, said stanchion comprising a hollow tubular member.

8. The barrier of claim 2, further comprising means to mount said sheeting to said pivot means to mount said stanchion whereby a first portion of said sheeting moves together with the stanchions and a second portion of said sheeting does not move being mounted on said means to mount said stanchions.

* * * * *